US006793148B2

(12) United States Patent
Ratnik

(10) Patent No.: US 6,793,148 B2
(45) Date of Patent: Sep. 21, 2004

(54) WATER-ONLY METHOD AND APPARATUS FOR MAKING SNOW

(75) Inventor: H. Ronald Ratnik, Pittsford, NY (US)

(73) Assignee: Ratnik Industries, Incorporated

( * ) Notice: Subject to any disclaimer, the term of this patent is extended or adjusted under 35 U.S.C. 154(b) by 203 days.

(21) Appl. No.: 10/215,686

(22) Filed: Aug. 10, 2002

(65) Prior Publication Data

US 2004/0035947 A1 Feb. 26, 2004

(51) Int. Cl.[7] ..... F25C 3/04
(52) U.S. Cl. ..... 239/2.2; 239/14.2; 239/575; 239/DIG. 23
(58) Field of Search ..... 239/2.1, 2.2, 14.1, 239/14.2, 575, DIG. 23

(56) References Cited

U.S. PATENT DOCUMENTS 3,596,476 A * 8/1971 Jakob et al. ..... 239/14.2
3,762,176 A * 10/1973 Coggins, Jr. ..... 239/14.2
5,810,251 A * 9/1998 McKinney ..... 239/2.2
6,152,380 A * 11/2000 Dupre ..... 239/14.2
6,182,906 B1 * 2/2001 Dupre ..... 239/14.2

* cited by examiner

*Primary Examiner*—Robin O. Evans
(74) *Attorney, Agent, or Firm*—Warren W. Kurz, Esq.

(57) ABSTRACT

A method and apparatus for producing man-made snow without using either compressed air or high-speed fans. The method makes use of a special water nozzle that is designed to provide a high volume spray of water particles that, owing to their size distribution (having a median size of between about 100 and 200 microns) in the spray, are readily susceptible to conversion to ice crystals as they settle to earth under favorable ambient conditions. Preferably, water applied to the nozzle is seeded with artificial nucleation sites so that water particles in a spray containing such sites are more susceptible to conversion to ice crystals as the particles settle to earth.

17 Claims, 8 Drawing Sheets

WATER-ONLY METHOD AND APPARATUS FOR MAKING SNOW

FIELD OF THE INVENTION

The present invention relates to the field of snow-making. More particularly, it relates to improvements in methods and apparatus for producing man-made snow from water only, i.e., without the additional use of either compressed air or high-speed fans.

BACKGROUND OF THE INVENTION

Various methods and apparatus have been devised over the years for assisting Mother Nature in producing snow at ski resorts and the like. More recently, such snow-making methods and apparatus have even been used at water-treatment facilities for converting winter waste-water to snow which takes the place of a secondary treatment usually required for such water. To date, most man-made snow has resulted by suitably combining air and water under certain favorable conditions. Typically, man-made snow is produced by propelling a relatively fine spray of water particles into the air while cooling the water particles with a rush of turbulent air, as provided by either a source of compressed air or by a high-speed, motor-driven fan. Ideally, the air passing through the spray causes the temperature of the water particles to quickly fall below a critical temperature at which ice crystals (i.e. man-made snow) form from each particle. Whether or not such crystallization occurs, as well as the "quality" of such crystallization, depends on several factors. These factors include (i) water particle size, (ii) ambient atmospheric conditions (viz., temperature, relative humidity and wind speed), (iii) "hang-time" or flight-time of the particles before settling to earth, and (iv) the velocity of the turbulent cooling air passing through the water spray.

Water particle size is particularly relevant to the snow-making process since, from a physics standpoint, a relatively small particle (i.e., a particle having a relatively small mass and small surface area through which cooling can occur) can be more quickly cooled than a larger particle (with a correspondingly larger mass and surface area). Note, the surface area of the particle increases with the square of the particle's diameter. Particle size is determined by both the physical characteristics of the nozzle(s) used to produce the water spray, and the water pressure applied to such nozzles. Generally speaking, the smaller the diameter of the nozzle orifice through which water is projected, the smaller the median diameter of the water particles produced. On the other hand, the greater the water pressure applied to the orifice, the smaller the water particles produced. Ideally, the water particles created to produce man-made snow should be sufficiently small to facilitate a rapid conversion to ice crystals, but not be so small as to allow the particles to be either (a) wind-blown from the intended region of snow accumulation, or (b) evaporated in the ambient air, in which case the particles convert to water vapor rather than forming ice crystals.

Equally as important as particle size to snow-making are the ambient atmospheric conditions under which air and water particles are combined to produce snow. Of course, the colder and drier the ambient atmosphere, the easier it is for water particles to convert to ice crystals. Since water normally freezes (crystallizes) at a wet bulb temperature of 32° Fahrenheit (0° Centigrade), the closer the initial temperature of the propelled water particles to the freezing temperature, the faster the conversion from water particles to ice crystals.

Further, the colder and drier the conditions, the better the quality of the snow deposit, assuming a dry, powdery snow is what is desired. Warm, wet conditions give rise to an undesirable, moisture-laden snow pack in which a large percentage of water particles have not been frozen.

Wind speed is relevant to the snow-making process due to its effect on a particle's "hang-time", i.e., how long a particle stays airborne after being propelled into the air. Obviously, the longer a particle remains air-borne, the better its chance for attaining the temperature change required for crystallization. But a wind speed too high is detrimental to snow-making in that the snow deposit may not occur at the desired location. Particle hang-time also depends on (a) the water pressure applied to the water nozzle, the higher the pressure, the longer the hang-time, (b) the elevation of the water nozzle above ground level, and (c) the direction in which the water spray is directed relative to ground level. Usually, to enhance the hang-time of water particles, the snow-making apparatus is mounted atop a tower, typically measuring between 3 and 12 meters, and the water spray is directed upwardly from horizontal to provide for a relatively long particle flight time even on a still day.

Finally, the speed of the cooling air (provided by either a compressed air source or a rapidly rotating fan blade) passing through the water spray determines, in large part, the particle-to-crystal conversion efficiency. The turbulent cooling air operates to quickly transport thermal energy (via convection and evaporation) from the water particles, and the faster the air flow, the greater the number water particles converted to ice crystals, and the larger the size of water particle that can be converted.

It is well known that the production of ice crystals in a water spray can be dramatically enhanced by increasing, within the spray, the number of "nucleation site" (i.e., sub-micron and micron-sized particles) about which crystallization commonly occurs. It is well established that water particles containing a nucleation site (e.g. a dust particle or a small mineral particle in the water) will form an ice crystal more readily than water particles having no such site. Thus, it is common in the field of snow-making to introduce a relatively large number of nucleation sites into the water used to make snow. The introduction of nucleation sites can be effected by either (a) injecting the nucleation sites into the water supply prior to producing the water spray, or (b) injecting the nucleation sites into the water spray after the fact. With regard to the first approach, two commercially available products that operate, when added to a water supply, to supplement the nucleation sites in a water spray produced from such supply are Snomax® Snow Inducer (made and sold by York International), and Freezyme Snowmaker (made and sold by Samyang Genex). Both of these products comprise tiny microorganisms (dead) that are adapted to be mixed with water to form a concentrated suspension that can then be injected, in metered amounts, into the water supply as snow is being made.

As regards the second approach (noted above) of injecting nucleation sites into a water spray made from a water supply containing no artificial sites, reference is made to the commonly assigned U.S. Pat. No. 5,884,841 to Ratnik et al. This patent discloses a snow-making apparatus in which tiny, micron sized, particles of ice (nucleation sites) are injected into a bulk water spray by a plurality of external "nucleators", i.e. nuclei-producing devices, that are positioned at equally-spaced locations outside the water spray, The bulk water spray itself is produced by one or more water nozzles, each having a single orifice or hole through which a flat or conical spray of water particles is produced. Each orifice is sized to produce a spray of water in which the median diameter of the water particles is preferably no greater than about 300 microns when a water pressure of about 500 pounds/inch$^2$ (PSI) or 170 Kg./cm$^2$ is applied. This translates to a nozzle hole diameter of about 0.11 inch (2.8 mm.). Note, recent developments of the bulk water nozzle used in this system have included the addition of up to twelve orifices per nozzle, such orifices being arranged in a circular pattern and oriented to direct their individual sprays of water particles in diverging directions to prevent their immediate interaction with each other (which would otherwise result in the formation of larger droplets). The individual orifices of this nozzle have been as small as 0.046 inch (1.17 mm.), which gives rise to water particles having a median particle size between 132 and 179 microns, depending on the applied water pressure (between 600 and 300 PSI, respectively). Each of the aforementioned nucleators comprises the combination of a relatively small, single orifice, water nozzle, and a small compressed air nozzle. The water nozzle of each nucleator serves to project a fine mist of water particles into the air, and the compressed air nozzle serves to simultaneously cool such water particles in the mist, thereby converting them to tiny ice crystals. The force and direction of the compressed air also serves to inject such tiny ice crystals into the main water spray, thereby providing the desired nucleation sites for the water droplets in the spray to convert to ice crystals. The compressed air also has an inherent cooling effect on the water particles of the bulk water spray that further facilitates crystallization. Compared to other snow-making systems, this particular system is considered highly advantageous from the standpoint that it converts a relatively high volume of water to snow with relatively little use of compressed air, the latter being the most costly ingredient of snow-making. Note, in this apparatus, the only compressed air required is that used to produce and inject the ice nuclei into the water spray. Further, there is no need for a snow-inducer (e.g. the above-noted biological water-additives) to produce an abundance of snow.

In making snow by the conventional methods alluded to above, the need for compressed and/or fan-driven air as a catalyst to the droplet-cooling process has always been problematic. Not only are compressed air sources and/or large, motor-driven fans costly to produce, maintain and operate, they are also difficult to transport up and down mountainsides. Moreover, the need for fast-moving air presents a noise problem, as anyone will attest who has ever been in close proximity to an operating snow gun. Thus, it would be highly desirable to eliminate all-together the use of supplemental air in the snow-making process, or at least, require its use only under the marginal atmospheric conditions in which snow-making has always been difficult, at best, (e.g., at wet bulb temperatures above about 25 degrees F.).

It is acknowledged that, at different times during the development of the snow-making industry, attempts have been made at providing a snow-making system in which water alone is used to make snow. One such system that has been recently commercialized is the "WaterStick™ Water-Only snow-making system made and sold by York Snow, Inc. This system requires the use of a nuclei-seeded water supply, e.g. a water supply in which the above-noted Snowmax snow inducer has been added, The system hardware (illustrated in FIG. 1) simply comprises a relatively long water pipe 10 having three water nozzles 12 mounted in a cap 14 that encloses one end of the pipe. The water pipe is a common 3 inch (7.5 cm.) diameter aluminum pipe, about 25 to 35 feet (8 to 11 meters) in length. In use, the pipe is arranged in a vertical orientation to position the nozzles at a relatively high elevation that provides for a relatively long flight-time for the water particles projected into the atmosphere by the nozzles. As shown, each of the nozzles is tilted upwards in the cap so as to direct the water spray WS further upwards relative to a horizontal plane. Each of the three nozzles has but a single oval-shaped hole 16 or orifice through which the water particles are projected, and the hole is structured so as to project the water spray through an angular range of about 50 degrees. The hole in each nozzle is centered in a V-shaped notch 18 that serves to produce a relatively flat water spray. To adjust for different ambient conditions, the nozzles are readily removable from the cap 14 so that a change in hole size can be readily effected. In the Waterstick system, the nozzle holes can vary in nominal diameter from about 0.109 inch (2.77 mm.) to about 0.188 inch (4.70 mm.) Thus, on a relatively cold day (say, less than 15 degrees F. wet bulb temperature), a nozzle with the largest hole size would be selected. Such a hole size is desirable from the standpoint that it will provide about three times the throughput (capacity) of the smallest nozzle hole provided (e.g., about 19 gallons per minute (GPM) at 400 PSI for a 4.70 mm. hole, versus only about 6 GPM at the same water pressure for a 2.77 mm. hole). The disadvantage of using a large nozzle hole, of course, is that, for a given water pressure, it produces a spray comprising much larger water particles than does a smaller nozzle hole. For example, at a water pressure of 400 PSI, the median water particle size projected by the largest Waterstick nozzle is about 440 microns, versus a median particle size of about 380 microns for the smallest nozzle. While water particles in this size range will crystallize without an assist from compressed air or the like when projected from high elevations (e.g., above 10 meters) and at low ambient wet bulb temperatures (e.g., less than 15 degrees F.), such particles cannot be converted to snow at ambient wet bulb temperatures higher than 20 degrees F., and/or when the particles are projected from elevations much lower than 10 meters. While somewhat smaller water particles can be achieved with the Waterstick nozzles by increasing the applied water pressure from 400 to, say, 600 PSI, the smallest median particle size achievable at this pressure is only about 270 microns, that being with the smallest nozzle size(0.109 inch). But even with particle sizes this small, it is not possible to make snow with the WaterStick system at ambient wet bulb temperatures above about 19 degrees F., even were the spray to be produced at an elevation of 12 meters. Note, while the WaterStick cap supports a total of three nozzles and, hence, can theoretically achieve a throughput three times that of a single nozzle, it has been found that, except at extremely low ambient temperatures, the center nozzle must be deactivated (i.e. plugged); otherwise, the "bloom" of snow projected by the nozzles becomes highly saturated with water, resulting in the production of a heavy, moisture-laden snow deposit. Thus, while the WaterStick System does, in fact, operate to produce snow without the use of any compressed air or fan, it does so under relatively restricted atmospheric conditions, e.g. requiring an ambient wet bulb temperature of at most 19 degrees F., and an elevation of at least 8 or 9 meters. Further, using only single-hole nozzles, the capacity of this system is relatively limited in terms of gallons of water converted to snow per minute.

SUMMARY OF THE INVENTION

In view of the foregoing discussion, an object of this invention is to provide an improved method and system for making snow without the use of either compressed air or high speed, motor-driven fans and the like.

Another object of this invention is to significantly expand the conditions under which man-made snow can be produced without the use of either compressed air or high speed fans, and to substantially increase the snow-making capacity of such systems.

Still another object of this invention is to provide a new water nozzle, when used in a water-only snow-making system, enables the system to operate effectively at warmer ambient temperatures and from elevations relatively close to the ground.

In accordance with the present invention, it has been found that, by using a water nozzle of the type described herein in a water-only snow-making system of the type described herein, the throughput of the system, compared to conventional systems, can be significantly increased (by as much as a factor of five). Further, by virtue of the invention, snow can be produced from water only at significantly higher ambient wet bulb temperatures than is possible with conventional water-only systems (e.g., 5 degrees F. warmer) and at elevations significantly closer to ground level (i.e., about one-half the elevation required by conventional systems), thereby better assuring that the snow is deposited when and where it is desired.

According to a first aspect of the invention, a preferred water-only method for producing snow comprises the steps of: (a) pre-seeding a water supply with artificial nucleation sites about which water particles produced from such supply and containing such artificial nucleation sites can crystallize; (b) filtering the pre-seeded water supply to filter out solid particulate matter of a size 0.015 inch (0.38 mm.) and larger; (c) providing a water nozzle having a plurality of spaced holes, each hole measuring between about 0.030 inch (0.75 mm.) and 0.040 inch (1.0 mm) in diameter; (d) supporting the nozzle at a level of at least 10 feet (3 meters) above ground level; and (e) directing the filtered and pre-seeded water through the nozzle holes at a pressure of between about 250 and about 800 PSI to produce a plurality of water sprays, each spray containing water droplets having a maximum median diameter of between about 100 and about 170 microns.

According to a second aspect of the invention, a preferred water-only system for producing snow comprises (a) a pre-seeded water supply having artificial nucleation sites about which water particles produced from such supply and containing such artificial nucleation sites can crystallize; (b) a filter for filtering out solid particulate matter of a size 0.015 inch (0.38 mm.) and larger from the pre-seeded water supply; (c) a water nozzle having a plurality of spaced holes, each hole measuring between about 0.030 inch (0.75 mm.) and 0.040 inch (1.0 mm) in diameter; (d) a tower for supporting the nozzle at a level of at least 10 feet (3 meters) above ground level; and (e) a pump for projecting the filtered and pre-seeded water through the nozzle holes at a pressure of between about 250 and about 800 PSI to produce a plurality of water sprays, each spray containing water droplets having a maximum median diameter of between about 100 and about 170 microns. Preferably, the water nozzle has at least sixteen holes through which water is projected arranged in a circular array, each hole being spaced from an adjacent hole by at least 0.25 inch (6.25 mm.).

According to a third aspect of the invention, a new and improved water nozzle is provided that is especially adapted for use in a water-only snow-making system. The nozzle comprises a housing defining a plurality of spaced holes. Owing to the size of the holes, the nozzle is capable of producing water particles of a size that will readily crystallize at wet bulb temperatures as high as 25 degrees F. when projected into the air from an elevation less than about 25 feet (8 meters). Owing to the number of holes, the nozzle provides a throughput or capacity, in terms of the volume of water converted to snow per unit time, significantly greater than the throughput of conventional nozzles used in water-only snow-making systems, Preferably, each of the holes has a nominal diameter of between about 0.030 and about 0.040 inches (about 0.75 to about 1.0 mm.) Preferably, the number of holes per nozzle is sixteen or more, and the holes are arranged in one or more circular arrays having nominal circle diameter of at least about 1.75 inches (44.5 cm.). Preferably, the spacing between adjacent holes in the circular array is at least 0.25 inches (6.3 mm.), and more preferably at least 0.35 inches (9 mm.). When two or more circular arrays of holes are used, the holes are preferably arranged to form two or more concentric circles.

The invention and its advantages will be better understood from the ensuing detailed description of preferred embodiments, reference being made to the accompanying drawings In which like reference characters denote like parts.

DETAILED DESCRIPTION OF PREFERRED EMBODIMENTS

Figure 1:
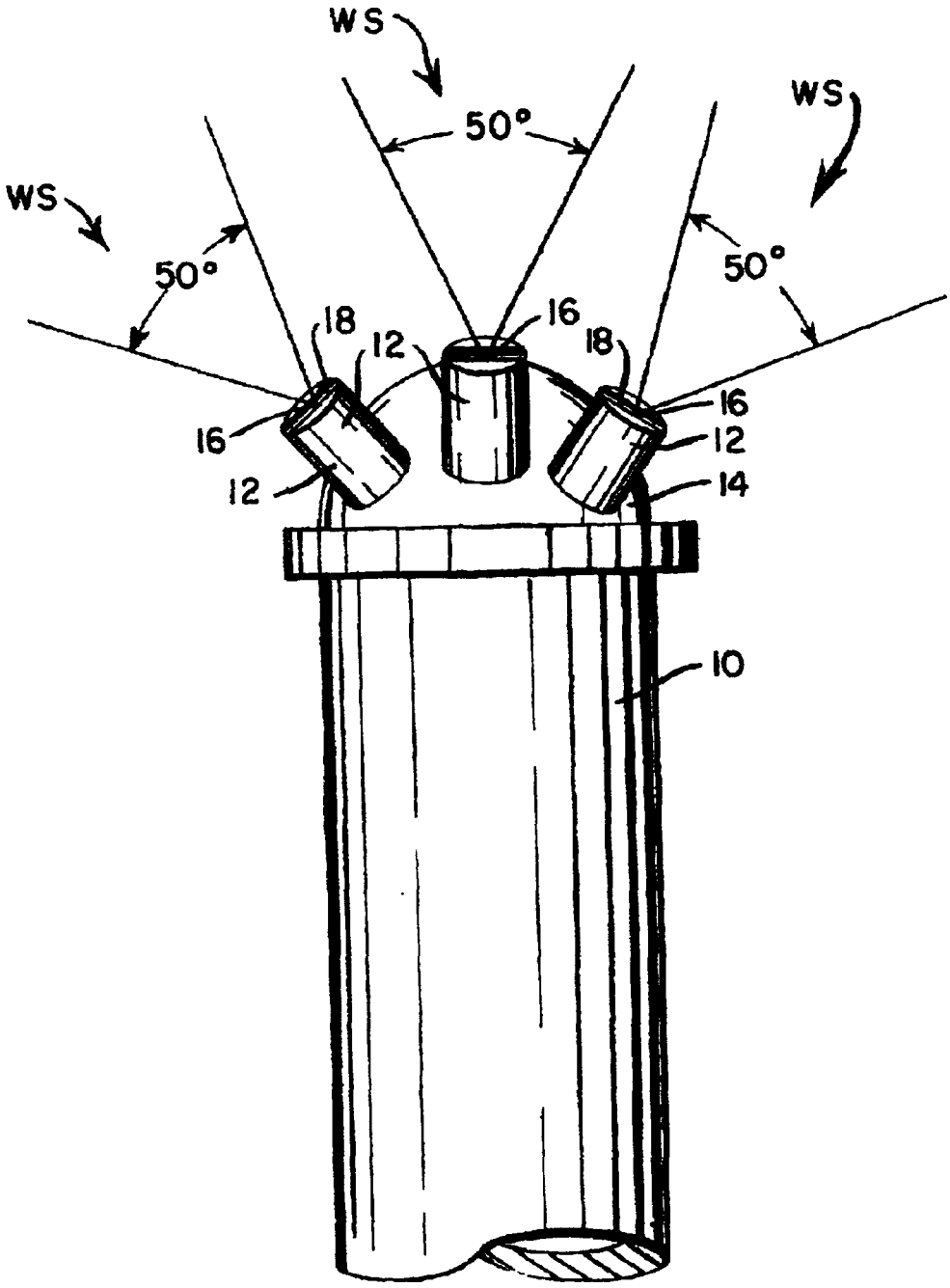
FIG. 1 (PRIOR ART)
FIG. 1 is a plan view illustrating prior art apparatus for making snow with water only.
Figure 2:
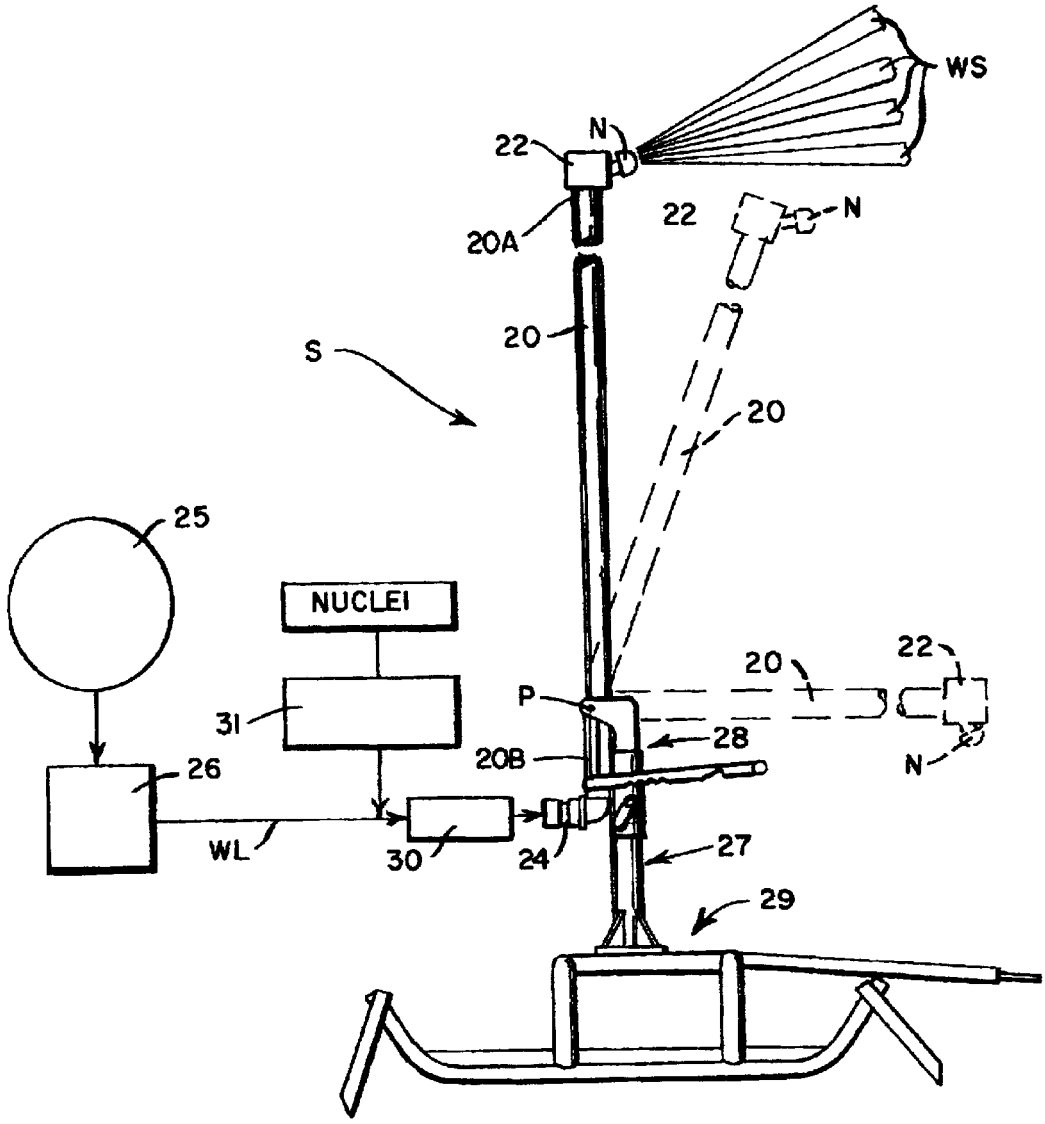
FIG. 2 is a schematic illustration of a snow-making system embodying the present invention.

Referring now to the drawings, FIG. 2 schematically illustrates a water-only snow-making system S embodying the invention. System S comprises an elongated water pipe 20 having a water-spraying head 22 mounted at one end 20A thereof. Head 22 supports one or more water nozzles N (only one nozzle being shown in FIG. 2). In sharp contrast with the water nozzles used in the above-noted WaterStick system in which each nozzle has but a single hole through which a single water spray is projected, each of the water nozzles N used in the apparatus of the invention has a plurality of holes through which a like plurality of separate water sprays WS is projected. Preferably, the number of water sprays WS produced by each nozzle N is no less than about sixteen and, as discussed below, may be two or three times this number. In further contrast to the WaterStick nozzles, the diameter of each of the many holes of nozzle N is significantly smaller, preferably only about one-third the diameter of the smallest nozzle hole used in the WaterStick system.

Still referring to FIG. 2, water pipe 20 is preferably a standard 2 or 3 inch (5.0 or 7.5 cm.) diameter aluminum pipe measuring between 10 and 25 feet (3.5 and 8 meters) in length. Pipe end 20B opposite head 22 is provided With a coupling 24 through which water is supplied to the water pipe and head 22 from a water supply 25 via a suitable pump 26 and water line WL (shown schematically). Water pump 26 is of conventional design and is adapted to supply water to the water pipe 20 at a pressure between about 250 to 800 PSI. Preferably, water pipe 20 is pivotally mounted on a stanchion 27 for movement about a support pin P from a horizontal position in which adjustments to the head 22 can be made from ground level, to a vertical, or near vertical, position in which head is supported at or near its maximum elevation above ground level. The pivotal position of the water pipe 20 is controlled by a notched lever and pin arrangement 28, or by a suitable jack-screw or the like. Stanchion 27 may be mounted atop a fixed support or, as shown, may be mounted on a portable sled 29 to render the apparatus mobile.

Figure 3:
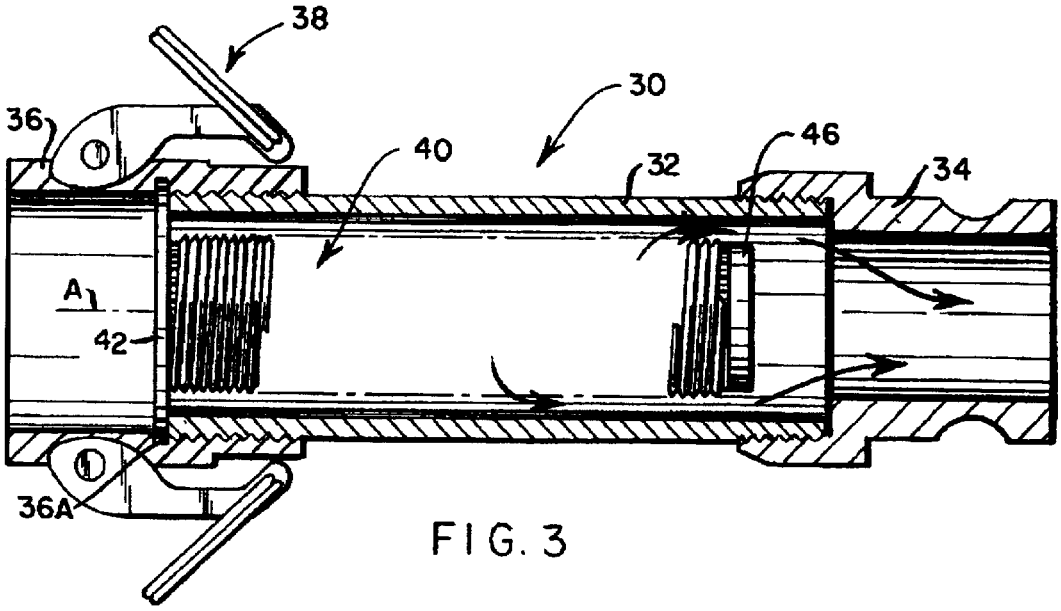
FIG. 3 is a sectional illustration of a preferred water filter assembly that is adapted for use in the system of FIG. 2.
Figure 4:
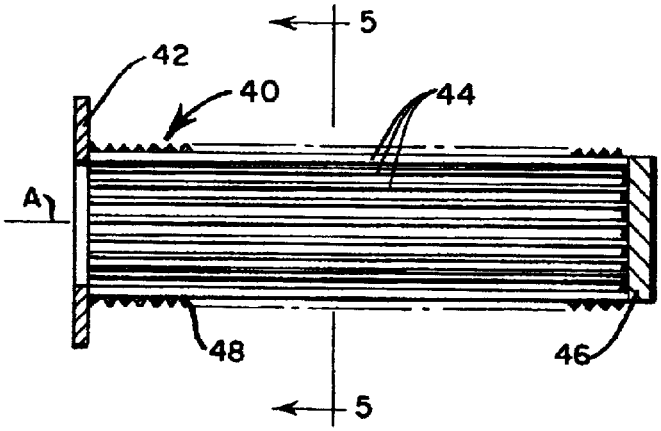
FIG. 4 is a sectional illustration of a water-filtering element used in the FIG. 3 assembly.
Figure 5:
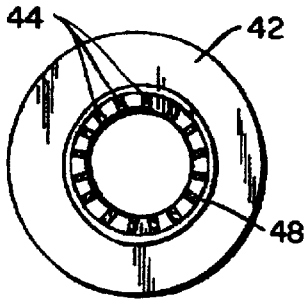
FIG. 5 is a sectional illustration of the water-filtering element of FIG. 4, taken along the section line 5—5.

A filter assembly 30, best shown and described below with reference to FIGS. 3–5, is positioned in the water line WL to filter out all particulate matter in the water supply that may tend to clog or otherwise interfere with the flow of water through the water nozzles N. This filtering is essential to prolonged successful use of the snow-making apparatus of the invention in that water supplies used for snow-making usually contain solid particles that would tend to clog the relatively tiny water-projecting holes of nozzle(s) N, thereby reducing the throughput of the nozzle and preventing the production of the small water particles necessary to achieve the advantages of the invention.

Referring to FIGS. 3–5, a preferred water filter assembly 30 comprises a relatively short water pipe section 32 having a male fitting 34 threaded on one end, and a female fitting 36 threaded on its opposite end. The male fitting is adapted to be engaged by the water pipe coupling 24, and the female fitting supports a clamp 38 adapted to engage a male fitting at one end of the water line WL. Pipe section 32 is about 10 inches (25 cm.) in length and, together with the female coupling, it supports a water filtering element 40. The latter comprises a flanged metal ring 42 that supports a plurality (about twenty) of elongated, equal length, metal ribs 44 that extend parallel to each other and to the longitudinal axis A of the filter element. One end of each rib 44 is welded to the inside surface of ring 42, and the respective opposite ends of the ribs are welded to the inside surface of a metal cup member 46 that encloses the cylindrical space defined by the parallel rib members. Preferably, all of these metal filter elements are made of stainless steel. A stainless steel wire 48 having a triangular cross-section is spirally wound about the cylindrical rib structure. The spacing between the adjacent wire turns on the rib support determines the effectiveness of the filter element in filtering out particles in the water supplied to it. Preferably, this spacing is set at approximately 0.012 inch (0.3 mm.), whereby all particles larger than this size are trapped in the interior of the filter element and are thereby prevented from passing to the interior of the water pipe 20. In use, the filter element 40 is positioned in pipe section 32 so that its flange 42 is trapped between the pipe end and a shoulder 36A on fitting 36. In this manner, the filter element is supported parallel to the pipe axis, in a cantilever fashion. Thus, unfiltered water entering fitting 36 is directed to the interior of the filter element, and filtered water passing radially outward through the spacing between the adjacent wire windings then flows into the pipe section, around the end cap 46 and out through fitting 34. As a result of its robust construction, the filter element can withstand a relatively high water pressure (in excess of 600 PSI) without collapsing or otherwise becoming distorted to the extent that it loses its intended effectiveness.

In using the snow-making apparatus of the invention at ambient wet bulb temperatures above 20 degrees F., it is necessary that the water supplied to the water pipe 20 be seeded with nucleation sites, i.e., sub-micron sized solid particles that facilitate the crystallization process by which the water particles in the water sprays WS become ice crystals. A preferred seeding product is the above-noted SnowMax snow-inducer. Thus, the apparatus of the invention further includes an injection pump 31 or the like for selectively introducing a suspension of snow-inducing nuclei into the water line as the ambient temperature rises above 20 degrees F. Note, at ambient wet bulb temperatures below 20 degrees F., no such seeding may be necessary to produce snow of an acceptable quality using the apparatus of the invention.

Figure 6:
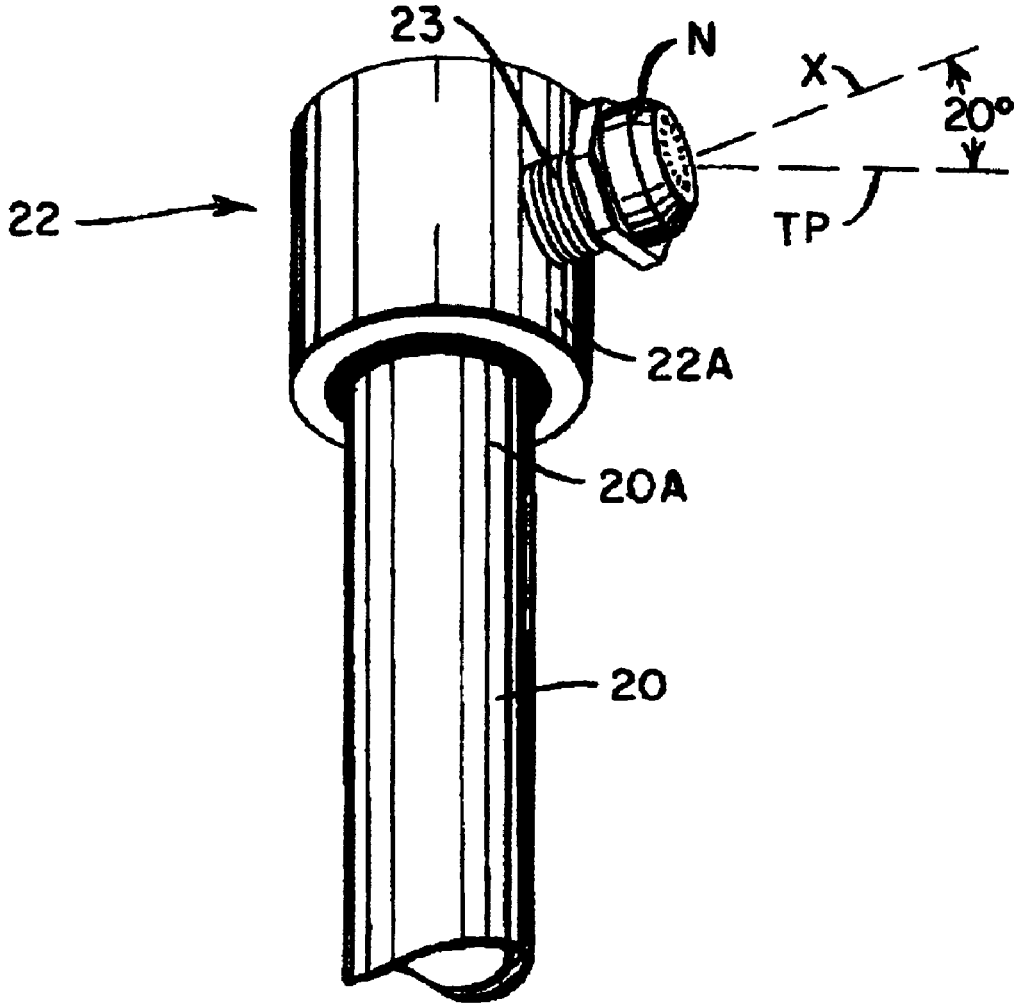
FIG. 6 is an enlarged perspective illustration of the water-spraying head used in the FIG. 2 system.

Referring to FIG. 6, the water-spraying head 22 shown in FIG. 2 is better illustrated as comprising a hollow cylindrical housing 22A that is closed at one end. The opposite, open end of housing 22A is welded to the open end 20A of water pipe 20 so that the Interior of the water pipe is in fluid communication with the interior of housing 22A. Preferably, housing 22A is made of aluminum and measures approximately 4 inches (10 cm.) in diameter and 3.5 inches (9 cm.) length. A threaded bore hole is formed through the cylindrical wall of the housing to receive a threaded nipple 23, preferably made of steel or brass, 1.5 inch (3.8 cm.) in diameter and about 2 inches (5 cm.) in length. As shown, nozzle N is threaded onto the end of the threaded nipple 23. By this threading arrangement, nozzles of differing spraying characteristics can be substituted for each other, as ambient conditions dictate. Preferably, the axis x of nipple 23 extends at about a 20 degree angle relative to the transverse plane TP of housing 22, whereby the water sprays produced by a supported nozzle N will be directed upwardly relative to the horizontal plane when the water pipe 20 is supported in its upright operational position. Various preferred nozzles N are described below with reference to FIGS. 7A–7C, 9A–9C, 10A and 10B, and 11A and 11B.

As indicated above, it is very important to the effectiveness of a water-only snow-making system to control the respective sizes, i.e., the median diameter, of the multitude of water particles comprising the individual water sprays WS shown in FIG. 2. The ideal water particle size varies, of course, with ambient wet bulb temperature, The closer the ambient wet bulb temperature is to freezing, the smaller the water particle must be in order for it to totally crystallize before it settles to ground level. As suggested above, making snow at wet bulb temperatures of 15 degrees F. and below without the use of compressed air or the like, is not problematic; due to the large temperature differential between ambient and freezing, water particles as large as 300 to 500 microns will convert to snow. The challenge is in making snow at relatively high ambient temperatures, i.e., at wet bulb temperatures above 20 degrees F. In accordance with the invention, it has been determined that, if snow is to be made from water alone at ambient wet bulb temperatures above about 20 degrees F. and from elevations below twenty five feet, then the median diameter of the water particles in the spray must be less than about 170 microns. Moreover, if snow is to be made at ambient temperatures of as high as 25 degrees F., it has been determined that the water particle size must be no larger than about 125 microns, and nucleation sites must be added to the water supply to achieve reliable crystallization. Presently, this wet bulb temperature (25 degrees F.) appears to be the highest temperature at which high quality (dry) snow can be reliably produced without the assistance of compressed air, high-speed fans or the like. While smaller water particles might be theoretically useful in producing snow at higher ambient temperatures, such particles are apt to evaporate before reaching the ground or be wind-swept to a location remote from that desired.

In accordance with a separate aspect of the invention, various water nozzle configurations (shown in FIGS. 7A–7C, 9A–9C, 10A and 10B, and 11A and 11*b*) are provided that are capable of producing multiple water sprays of particles of the sizes noted above when a water pressure between 250 and 800 PSI is applied to them. In each of these nozzles, the holes through which water is projected have a nominal diameter between about 0.030 inch (0.75 mm.) and 0.040 inch (1.0 mm.). It will be appreciated that these hole sizes are considerably smaller than those found in any commercially available water nozzles. Because the size of each hole is small, its throughput in terms liquid volume per unit time (GPM) is correspondingly small; however, owing to the large number of holes per nozzle, the collective throughput of the holes far exceeds the throughput achieved by conventional nozzles used in water-only snow-making systems. Thus, a single nozzle of the type described can be used to make a large volume of snow over a wide range of ambient temperatures.

Figure 7A:
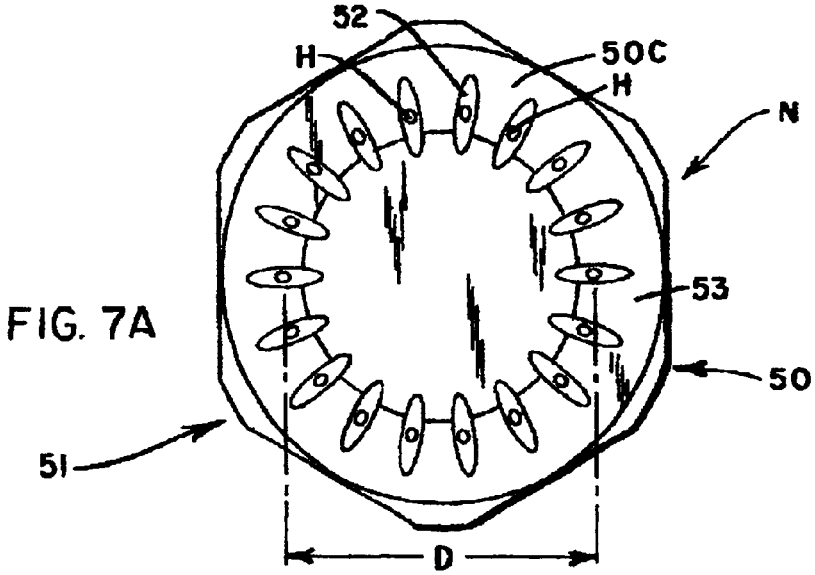
FIGS. 7A–7C are front, side (in partial cross-section), and rear views and of a preferred water nozzle comprising the FIG. 2 system.
Figure 7B:
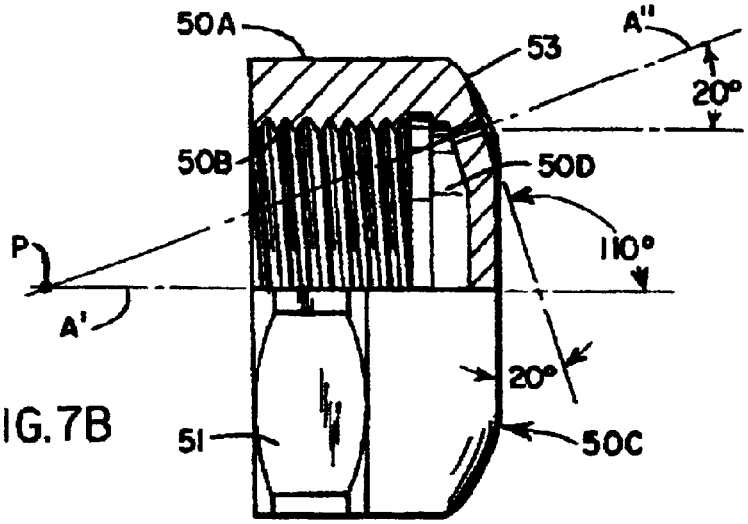
Figure 7C:
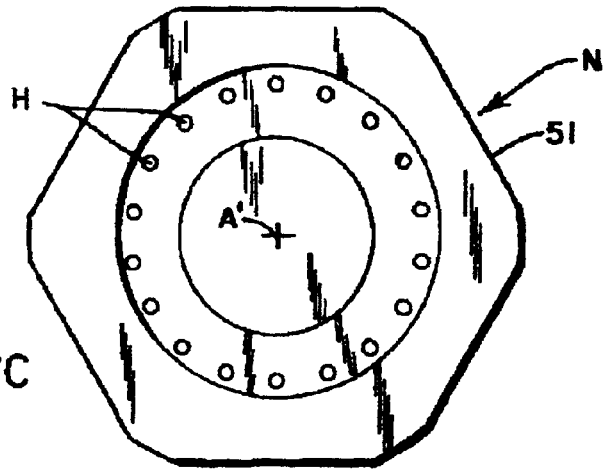

Referring now to FIGS. 7A–7C, a preferred water nozzle N for the FIG. 2 system comprises a one-piece, cup-shaped structure 50 cut from a single bar of metal, preferably brass or, more preferably, stainless steel. In this particular embodiment, structure 50 has an overall diameter of about 2.5 inches (about 6.25 cm.) As shown in FIG. 7B, structure 50 has a cylindrical side wall portion 50A having internal threads 50B adapted to engage and mate with the external threads of the hollow nipple 23 extending outwardly from head 22. About one half of the side wall of structure 50 is machined to define a hexagon feature 51 by which the nozzle can be turned with a wrench on nipple 23 to effect nozzle removal and replacement. Structure 50 further comprises a generally convex end portion 50C in which a beveled flat band 53 is formed. Band 53 is about 0.3 inches (7.5 mm.) in width, and its circular shape is centered about the nozzle axis A'. The plane of band 53 extends at about 110 degrees with respect to the nozzle axis A'. As shown in FIG. 7A, a circular array of holes H is formed in the beveled band portion, each of the holes H extending completely through end portion 50C, into the inner chamber 50D of the cup-shaped structure. The axis A" of each hole is normal to the plane of band 53; thus, the hole axes diverge from the nozzle axis A' at 20 degrees, and they converge at a point P on nozzle axis. Each hole serves to break-up pressurized water applied to the interior of structure 50 from the hollow nipple 23 to form a relatively fine water spray comprised of water particles having a Gaussian-shaped distribution of particle sizes. Owing to the angular orientation of the nozzle axes A", the water sprays diverge from each other as they leave the nozzle.

To achieve the preferred particle sizes noted above at the water pressures indicated, it has been found that the nominal diameter of the nozzle holes H must be between about 0.030 inch (0.75 mm.) and 0.040 inch (1.0 mm.) Preferably, each nozzle hole H is formed in the end portion 50C of structure 50 by first drilling an array of circular holes, and then cutting a radially-extending slot 52 (shown in FIG. 7A) in the beveled band 53 with a 90 degree cutter, atop each hole. This slotting and drilling operation gives rise to a hole having a generally oval shape when viewed from the front of the nozzle (as illustrated in FIG. 7A), and a circular shape when viewed from the rear of the nozzle (as illustrated in FIG. 7C). Slots 52 function to confine the water sprays so as to provide a flat, fan-shaped spray that is aligned with the slot. The depth of the slot is determined by the preferred hole diameter, the larger the hole diameter the deeper the slot depth. More specifically, for hole diameters of between about 0.030 inches (0.75 mm.) and 0.040 inches (1.0 mm.), the preferred slot depth varies between about 0.038 inch (about 0.96 mm.) and 0.045 inch (1.04 mm.), respectively. In the nozzle shown in FIGS. 7A–7C, the circular array of holes has a preferred nominal diameter D of between 1.5 inches (3.8 cm.) and 4.0 inches (10 cm.), and the number of holes on such a circle is at least sixteen. Such a number of holes provides for a hole spacing S of at least about 0.25 inches (6.25 mm.), and more preferably, greater than 0.35 inches (about 8 mm.). The combination of the hole size, hole spacing, hole circle diameter and the divergence of the water sprays emerging from the holes operates to delay the ultimate collision of water particles projected from adjacent holes for a time sufficient to enable many of the smaller water particles to convert to ice crystals before colliding with other particles and combining to form larger particles. Further, many of the smaller water particles of the particle size distribution (e.g., those being between 25 and 100 microns in size) quickly convert to tiny ice crystals that act as nucleation sites for the larger water particles in the spray, thereby facilitating the conversion of such larger particles to ice crystals. In addition to the significantly smaller water particles produced by nozzle N, this external "seeding" phenomenon further facilitates water-only snow-making at significantly warmer temperatures than has been achieved heretofore.

The table below compares, at three different water pressures, the median water particle size produced by two different water nozzles, viz., the smallest nozzle (0.109 inch hole size) used in the WaterStick system, and two different nozzles N of the type described above in which the nominal hole diameter of one is 0.038 inches, and the nominal hole diameter of the other is 0.030 inch.

| | WaterStick Nozzle Median Particle Size | Nozzle N (0.038 in.) Median Particle Size | Nozzle N (0.030) Median Particle Size |
|---|---|---|---|
| 300 PSI | 460 microns | 169 microns | 159 microns |
| 400 PSI | 380 microns | 149 microns | 142 microns |
| 600 PSI | 270 microns | 128 microns | 124 microns |

The above table illustrates that, even using the smallest orifice available with the WaterStick system, in which the smallest water particles possible are produced, the particle size (diameter) is more than twice the particle size obtained with the nozzle described above. This results in a particle surface area (through which particle-cooling occurs) that is many times larger than that of the particles produced by nozzles N. Because the particles produced by the inventive nozzle are smaller, they cool more quickly and require less hang time to covert to ice crystals. Thus, by virtue of the invention, it has been found that snow can be made without the use of an auxiliary air source (e.g., compressed air or fans) at significantly warmer ambient temperatures (about 5° F. warmer than is possible using the WaterStick System), and from elevations much closer to ground level (at about one-half the elevation required by the WaterStick system), thereby rendering the snow deposition less susceptible to wind gusts.

Figure 8:
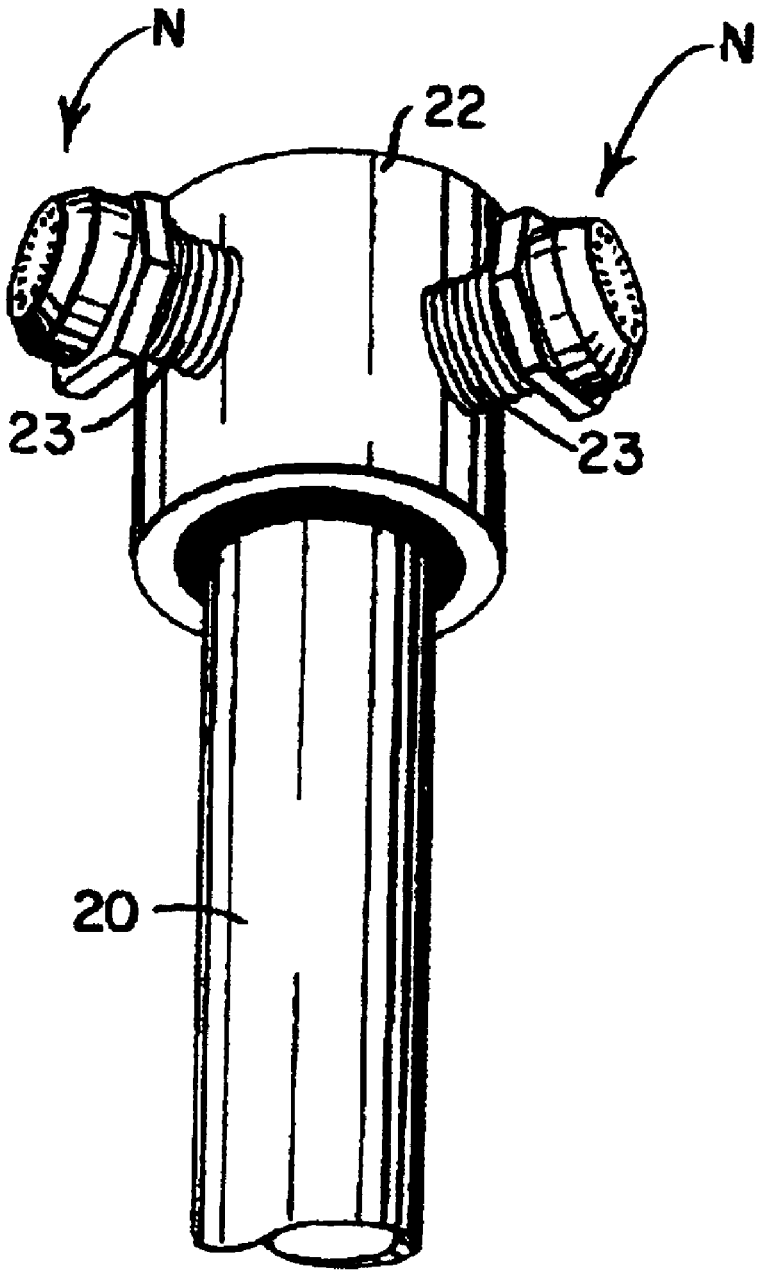
FIG. 8 is a perspective view of a twin nozzle water-spraying head.

As suggested above, the throughput of any snow-making system (in terms of gallons of water converted to snow per minute) is an important factor to the success of any such system. For a given water pressure, the smaller the hole size, the lower the throughput. Since the hole size of the nozzle of the invention is considerably smaller than that used heretofore, the throughput would be correspondingly smaller were only one hole formed in the nozzle. However, as described above, the preferred nozzle of the invention has at least eighteen (and preferably more) holes per nozzle, and the holes are arranged so that the water spray produced by each does not substantially interfere with the water spray produced by the adjacent holes. Thus, the throughput of the nozzle N is determined by multiplying the throughput of any single hole by the number of holes per nozzle. Further, as shown in FIG. 8, two or more nozzles N can be supported by each head 22. The following Table compares the throughput (gallons of water per minute, GPM) of the snow-making system of the invention with that of the WaterStick system. In each case, two nozzles are used, as described in the above Table, each operating at the water pressures shown:

| | Nozzles 12 (0.109 in.) Throughput | Nozzles N (0.038 in.) Throughput | Nozzles N (0.030) Throughput |
|---|---|---|---|
| 300 PSI | 11.0 GPM | 36.0 GPM | 24.0 GPM |
| 400 PSI | 12.8 GPM | 44.0 GPM | 28.0 GPM |
| 600 PSI | 15.6 GPM | 52.0 GPM | 33.6 GPM |

From the above Table, it will be appreciated that, using two of the 18-hole nozzles N shown in FIGS. 7A–7C results in a throughput of the present system that is 2 to 3 times greater than that achievable by the WaterStick system using its smallest nozzle. While using a larger WaterStick nozzle (i.e., one with an even larger hole) can result in a greater throughput, this would only reduce its effectiveness at producing water-only snow at relatively warm ambient temperatures. Note, the throughput of the present system can be further increased with no effect on particle size by using any of the nozzles shown in FIGS. 9A, 10A and 11A. For example, using two of the 32-hole nozzles shown in FIG. 10A where the hole size is 0.038 inch will result in throughputs of 55.4 GPM, 64.0 GPM, and 78.4 GPM at water pressures of 300, 400 and 600 PSI, respectively. This amounts to a five-fold increase over the throughput of the smallest WaterStick nozzle, i.e., the nozzle that is best suited for making snow under relatively warm conditions.

Figure 9A:
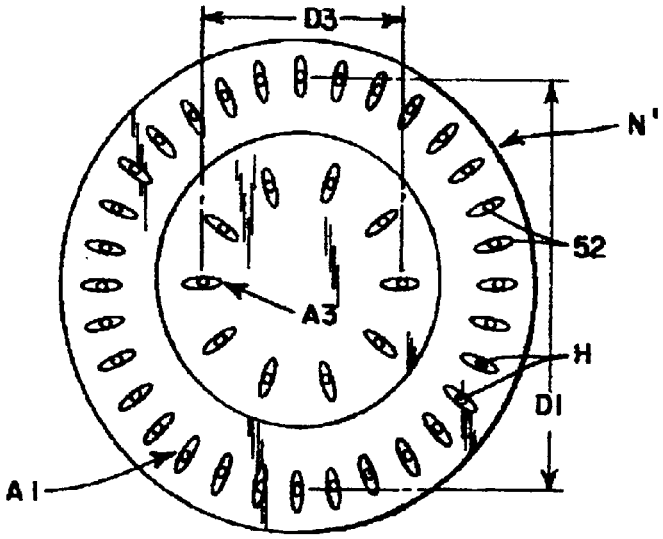
FIGS. 9A–9C are front, cross-section and rear views of another water nozzle adapted for use in the FIG. 2 system.
Figure 9B:
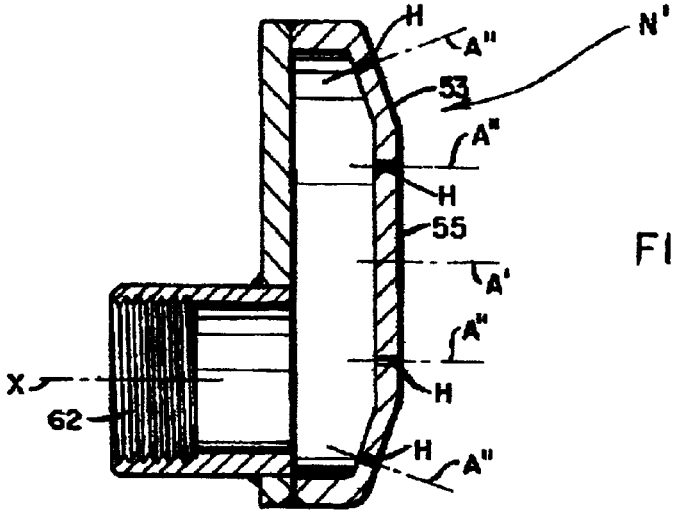
Figure 9C:
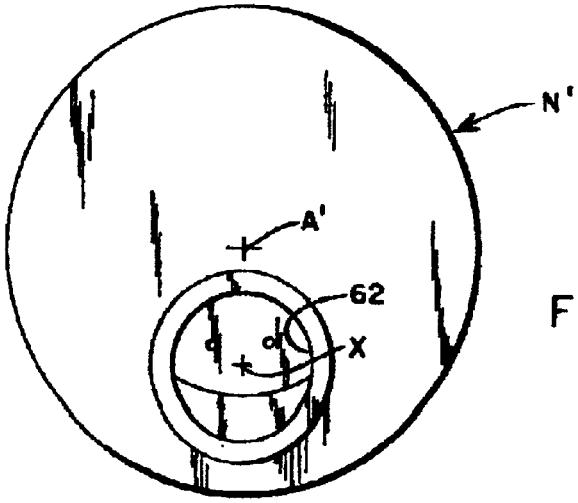

In FIGS. 9A–9C, another preferred nozzle configuration is illustrated as having two concentric circular arrays A1, A3 of holes H. In this embodiment, the overall diameter of nozzle N' is increased to provide for a four inch (12 cm.) diameter D1 for array A1. The diameter D3 of array A3 is about 2 inches (6.0 cm.). The respective holes of array A1 are formed in the aforementioned beveled band 53 on the convex end 50C, and the holes of array A3 are formed in the flat central portion 55. Thus, the sprays produced by the holes of the two arrays diverge from each other as they leave the nozzle. As shown in FIGS. 9B and 9C, that threaded portion 62 of the nozzle that engages nipple 23 is offset from the nozzle axis A' to allow for the drainage of any water remaining in the interior chamber of the nozzle after use. Here, the total number of nozzle holes is forty-two. Thus, the throughput of nozzle N' is more than twice that of nozzle N above. Again, as in the case of nozzle N, each hole in nozzle N' has a diameter of between 0.030 and 0.040 inch.

Figure 10A:
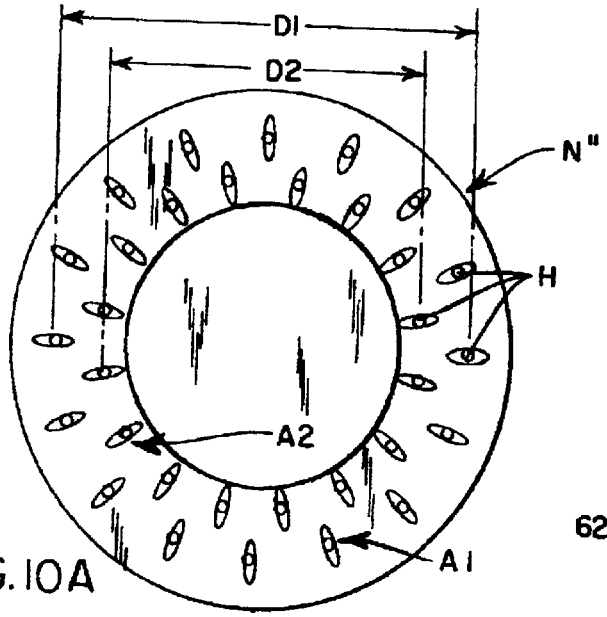
FIGS. 10A, 10B, 11A and 11B are front and cross-sectional views of two other nozzle configurations that are useful in the snow-making system of FIG. 2.
Figure 10B:
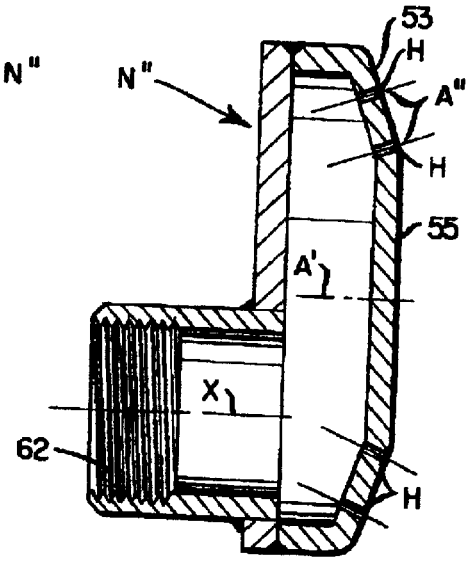

In FIGS. 10A and 10B, another preferred nozzle N" is shown. This nozzle is similar to the nozzle shown in FIG. 9A, the differences being that the inner circular array A2 has a larger diameter D2 (preferably 3 inches) than the diameter D3 of array A3 in the FIG. 9C nozzle, and the holes of the two arrays are offset radially from each other to minimize the interaction of adjacent sprays as they leave the nozzle. Both arrays A1 and A2 are formed in the beveled band 53. In this embodiment, there is a greater spacing between adjacent holes in the outer array A1. The total number of holes in this nozzle is thirty-two.

Figure 11A:
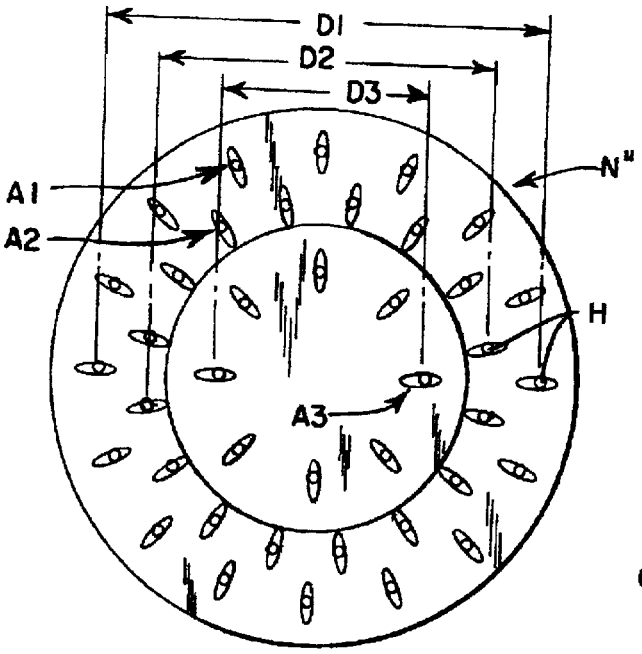
Figure 11B:
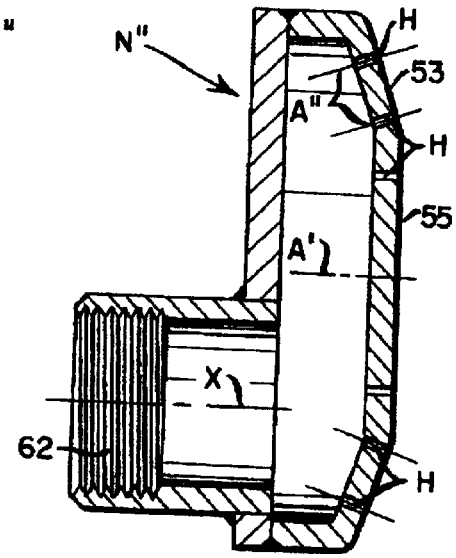

In FIGS. 11A and 11B, still another nozzle N'" is shown. This nozzle has three concentric circular arrays A1, A2 and A3, of holes H, two of the arrays being formed in beveled band 53, and the third being formed in flat portion 55. The total number of holes in this nozzle is forty.

From the foregoing, it will be appreciated that significant advantages result from use of the water-only snow-making system described herein. Specifically, water can be converted to snow at a rate approximately five times faster than the rate achieved by conventional air-less snow-making systems (i.e., the above-noted WaterStick System) and, even more significantly, at ambient wet bulb temperatures about 5 degrees Fahrenheit warmer than the maximum temperature at which such conventional systems can operate. Thus, significantly more snow can be produced over a given period of time without resorting to compressed air or high speed fans. Further, the snow-making process of the invention can be carried out at an elevation significantly lower than that required by the prior art; thus, the deposition of snow is not as affected by wind gusts as is the case of the prior art method. These dramatic improvements in performance are attributable to the special water nozzle design, described herein, that enables the production of a large volume of water particles with a particle size distribution ideally suited to conversion to ice crystals.

While the invention has been described with reference to certain preferred embodiments, it will be appreciated that changes can be made without departing from the spirit of the invention. For example, in each of the nozzles described above, the holes are arranged in one or more circular arrays. While such circular configurations are clearly preferred, it is apparent that the arrays could take various shapes, e.g., rectangular, triangular, etc., without substantially affecting the interaction of water sprays. Thus, while the ensuing claims are intended to cover the preferred embodiments disclosed, they are also intended to cover as well variations of this type.

What is claimed is:

1. An air-less method for producing snow comprising the steps of:

(a) providing a water nozzle having a plurality of spaced holes, each hole having a nominal diameter of between about 0.030 and 0.040 inches;

(b) supporting the water nozzle at a level of at least 10 feet above ground level; and (c) directing water from a water supply through the nozzle holes at a pressure of between about 250 and about 800 PSI to produce a plurality of water sprays, each spray containing water droplets having a median diameter of between about 100 and about 200 microns.

2. The method as defined by claim 1 further comprising the step of directing the water sprays in an upward direction relative to horizontal from an elevation between 10 and 30 feet.

3. The method as defined by claim 1 wherein said water supply contains an additive adapted to act as supplemental nucleation sites about which ice crystals can form from water particles containing said sites.

4. The method as defined by claim 1 further comprising the step of filtering said water supply before directing water through said nozzle holes to prevent particles in said water supply having a size greater than about 0.030 inches from reaching said nozzle holes.

5. The method as defined by claim 1 wherein said water nozzle has at least 15 holes arranged in one or more circular arrays.

6. The method as defined by claim 5 wherein each of said holes is arranged in the center of a slot that extends radially towards the center of said circular array, said slot operating to confine the water spray passing through its associated hole to form a generally flat spray aligned with said slot.

7. The method as defined by claim 1 wherein the respective longitudinal axes of said holes converge at a point, whereby the respective water sprays produced by said holes diverge from each other as they leave the water nozzle.

8. Apparatus for producing man-made snow from water only, said apparatus comprising:

(a) a water nozzle having a plurality of spaced holes through which water can be projected, each of said holes having a nominal diameter of between about 0.030 and 0.040 inches;

(b) a tower for supporting said water nozzle at a level of at least 10 feet above ground level; and (c) means for directing water from a water supply through the nozzle holes at a pressure of between about 250 and about 800 PSI to produce a plurality of water sprays, each spray containing water droplets having a median diameter of between about 100 and about 200 microns.

9. The apparatus as defined by claim 1 further comprising means for injecting into a water line connecting said water supply and said nozzle a plurality of solid particles adapted to act as nucleation sites about which ice crystals can form from water particles containing one or more of such solid particles.

10. The apparatus as defined by claim 8 further comprising a filter for filtering said water supply before directing water through said nozzle holes to prevent particles in said water supply having a size greater than about 0.030 inches from reaching said nozzle holes.

11. The apparatus as defined by claim 10 wherein said filter comprises a filtering element comprising a wire spirally wound about a support, the spacing between adjacent windings of said wire determining the minimum particle size filtered by said filter.

12. The apparatus as defined by claim 8 wherein said water nozzle has at least fifteen holes arranged in one or more circular arrays.

13. The apparatus as defined by claim 8 wherein each of said holes is arranged in the center of a slot that extends radially towards the center of said circular array, said slot operating to confine the water spray passing through its associated hole to form a generally flat spray aligned with said slot.

14. The apparatus as defined by claim 8 wherein the respective longitudinal axes of said holes converge at a point, whereby the respective water sprays produced by said holes diverge from each other as they leave the water nozzle.

15. A water nozzle adapted for use in an air-less snow-making system, said nozzle comprising a housing defining an array of spaced holes through which water can be projected, each hole having a diameter of between about 0.030 and about 0.040 inches, said circular array having a diameter of at least about 1.75 inches, and adjacent holes being spaced apart by at least 0.25 inches.

16. The water nozzle as defined by 15 wherein said housing defines a plurality of concentric circular arrays of said holes.

17. The water nozzle as defined by 15 wherein said housing defines an inner chamber having a circular opening through which said chamber can receive water from a source of water, said opening having a central axis displaced from a central nozzle axis passing through the center of said array, whereby water in said chamber can drain therefrom when said nozzle is not in use.

* * * * *